US005836646A

United States Patent [19]

Salehi et al.

[11] Patent Number: 5,836,646

[45] Date of Patent: Nov. 17, 1998

[54] CLASSROOM CHAIR HAVING BOOKBAG HOOK

[75] Inventors: Ali R. Salehi, Wilbraham, Mass.; David P. Williams, Milford, Conn.

[73] Assignee: Columbia Manufacturing, Inc., Westfield, Mass.

[21] Appl. No.: 855,937

[22] Filed: May 14, 1997

[51] Int. Cl.[6] ..... A47C 7/62

[52] U.S. Cl. ..... 297/188.04; 297/452.2

[58] Field of Search ..... 297/452.18, 452.2, 297/440.2, 188.01, 188.04, 188.06, 445.1; 248/302, 303

[56] References Cited

U.S. PATENT DOCUMENTS

| | | | |
|---|---|---|---|
| D. 156,691 | 1/1950 | Belmont . | |
| D. 173,386 | 11/1954 | Ryan . | |
| 725,678 | 4/1903 | Cullum | 248/303 X |
| 727,119 | 5/1903 | Farish . | |
| 847,318 | 3/1907 | Cope . | |
| 1,788,009 | 1/1931 | Bestler . | |
| 2,100,261 | 11/1937 | Montgomery | 297/188.06 X |
| 2,263,863 | 11/1941 | Wolfe . | |
| 2,650,658 | 9/1953 | Choate | 297/188.04 X |
| 2,678,184 | 5/1954 | Erdody | 248/302 X |
| 2,706,517 | 4/1955 | Dexter et al. | 248/303 X |
| 2,807,315 | 9/1957 | Manne | 297/188.06 |
| 2,841,210 | 7/1958 | Nesselrodt | 297/186.06 |
| 2,890,800 | 6/1959 | Gibson | 297/188.06 X |
| 3,429,541 | 2/1969 | Herman | 248/302 |
| 4,143,845 | 3/1979 | Harris | 248/302 X |
| 4,711,488 | 12/1987 | Ohanessian . | |
| 4,807,929 | 2/1989 | Balsbaugh . | |
| 5,415,457 | 5/1995 | Kifer . | |
| 5,421,638 | 6/1995 | Ayotte et al. . | |

*Primary Examiner*—Milton Nelson, Jr.
*Attorney, Agent, or Firm*—McCormick, Paulding & Huber

[57] ABSTRACT

A bookbag hook formed from a cylindrical rod and secured to a classroom chair in fixed position between a backrest and a backrest supporting portion of the chair frame. The hook depends in generally cantilever position from the chair frame generally adjacent the rear surface of the backrest.

14 Claims, 3 Drawing Sheets

CLASSROOM CHAIR HAVING BOOKBAG HOOK

BACKGROUND OF THE INVENTION

This invention relates in general to school furniture and deals more particularly with improvements in classroom chairs.

In most secondary schools and colleges the student is not assigned a specific desk or work place where he or she may store books, papers, and other materials required for various class activities. The student must generally move from class to class carrying all of the materials required for proper class participation. a bookbag or knapsack is a virtual necessity, however, classroom furnishing do not usually provide adequate accommodation for such items. Consequently, students often find it necessary to place bookbags and knapsacks on the floor which may cause aisle blockage creating potentially serious tripping hazards and otherwise detracting from the overall orderly appearance desirable in a classroom environment. Further, it is essential that classroom aisles be kept clear in the event of a fire or other emergency requiring rapid classroom evacuation.

In response to the expressed concerns of school administrators and teachers responsible for classroom safety, it is the general aim of the present invention to provide an improved classroom chair having the facility for securing a bookbag, knapsack or the like in a convenient orderly storage position.

SUMMARY OF THE INVENTION

A classroom chair embodying the present invention includes a chair frame, a backrest, and fastening means for attaching the backrest to the chair frame. In accordance with the invention, a bookbag hook is secured to the classroom chair in a fixed position between the backrest and an associated portion of the chair frame to depend in generally cantilever position from the chair frame.

DETAILED DESCRIPTION OF PREFERRED EMBODIMENTS

Figure 1:
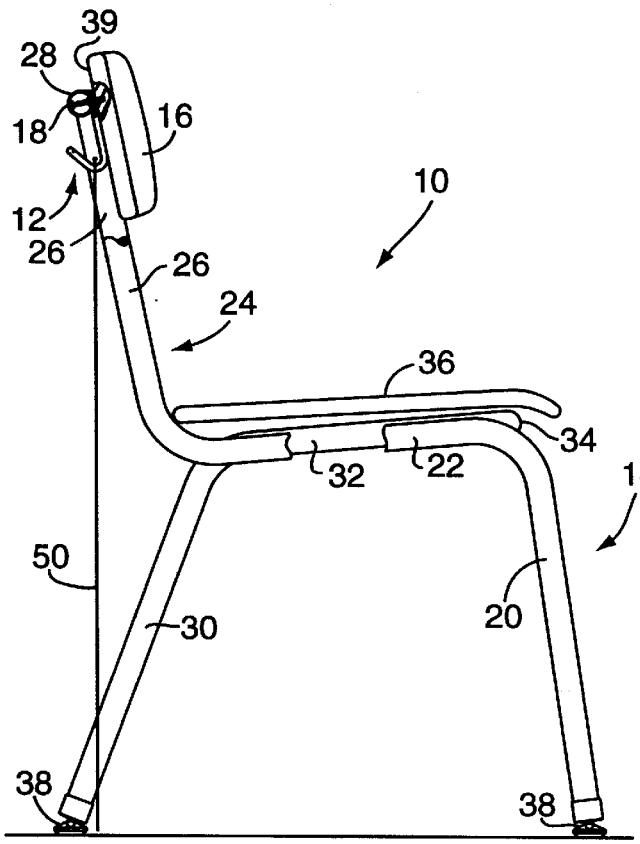
FIG. 1 is a fragmentary side elevational view of a classroom chair embodying the present invention.
Figure 3:
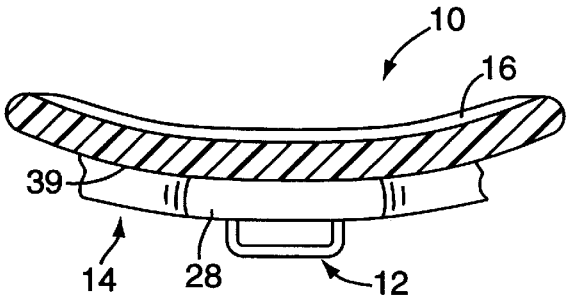
FIG. 3 is a somewhat enlarged fragmentary sectional through the chair backrest view taken along the line 3—3 of FIG. 2.
Figure 2:
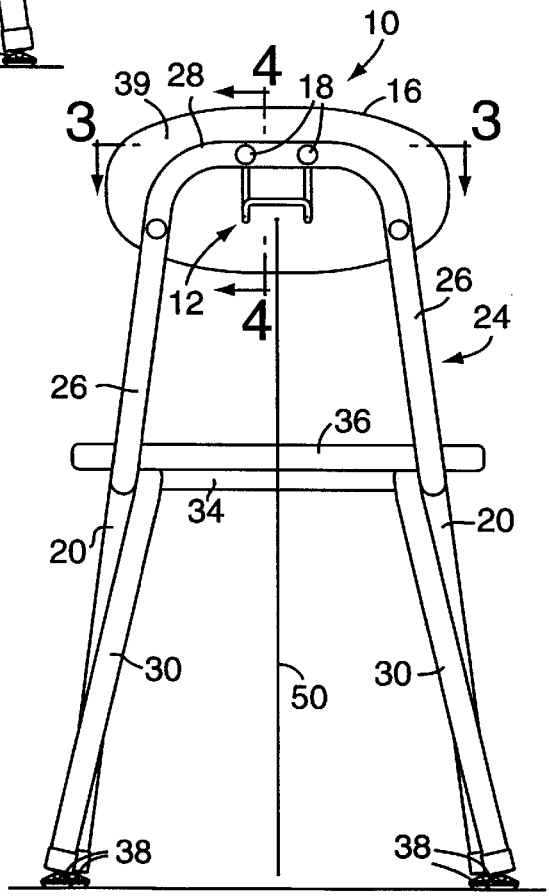
FIG. 2 is a rear elevational view of the classroom chair of FIG. 1.

Turning now to the drawings and referring first particularly to FIGS. 1–3, a typical classroom chair embodying the present invention and indicated generally by the reference numeral 10 includes a bookbag hook designated generally by the numeral 12. The illustrated classroom chair 10 has a frame, indicated generally at 14, which provides support for a substantially rigid backrest 16. Fasteners 18, 18 which secure the backrest 16 to the chair frame 14 also secure the hook 12 to the chair to depend in generally cantilever position relative to an associated portion of the chair frame, as will be hereinafter more fully discussed.

The illustrated chair 10 is of a generally conventional construction. The chair frame 14 is preferably made from cylindrical tubular steel, has a plated or painted finish and, as shown, includes two parts preferably welded together in assembly. More specifically, the frame 14 has a unitary first part which includes a pair of front legs 20, 20, a pair of side members 22, 22 (one shown in FIG. 1) and a backrest supporting structure indicated generally at 24. The backrest supporting structure 24 includes a pair of upwardly extending members 26, 26 and a horizontally disposed backrest support member 28 integrally connected to and extending between the upper ends of the support members 26, 26, as best shown in FIG. 2. The second part of the chair frame 14 also comprises a unitary member and includes a pair of rear legs 30, 30, a pair of inner side members 32, 32 and a cross member 34 which extends between and is integrally connected to the forward ends of the side members 32, 32. Each inner side member 32 is disposed inwardly of and generally adjacent an associated outer side member 22 and welded to it. The side members 22, 22 and 32, 32 form a seat supporting portion of the chair frame 14 and carry a rigid chair seat 36. The chair seat 36 is preferably secured in fixed position to the chair frame 14 by a plurality of fasteners (not shown). Conventional furniture glides 38, 38 are mounted on the lower or terminal ends of the front and rear chair legs 20, 20 and 30, 30, respectfully, substantially as shown.

The rigid backrest 16 and the rigid chair seat 36 are preferably molded from a thermosetting resin compound containing wood flour and a pigment and cured under heat and pressure in a manner well known in the art. The illustrated backrest 16 and chair seat 36 are generally anatomically contoured for comfort, the backrest having a generally arcuate configuration, as viewed from above and as best shown in FIG. 3. The horizontally disposed backrest support member 28 is also arcuately contoured to complement the backrest rear surface, indicated at 39, as best shown in FIG. 3. The bookbag hook 12 is mounted on the classroom chair 10 between the backrest 16 and the chair frame 14. However, before considering the manner in which the hook 12 is secured to the chair, the hook will be considered in somewhat further detail.

Figure 6:
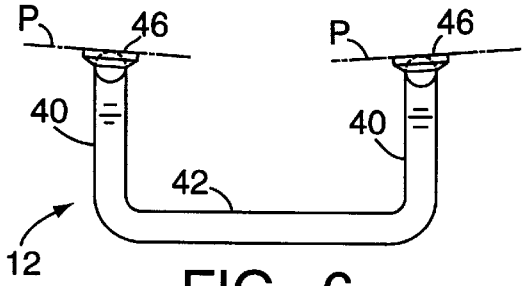
FIG. 6 is a top plan view of the bookbag hook as shown in FIG. 4.
Figure 7:
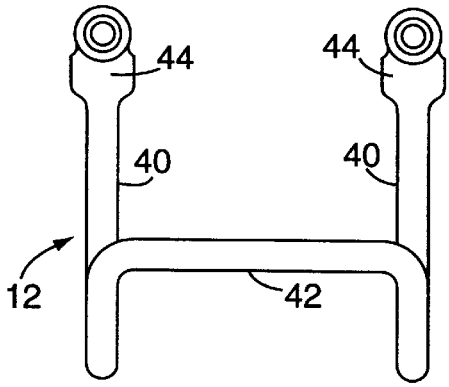
FIG. 7 is a rear elevational view of the bookbag hook.
Figure 5:
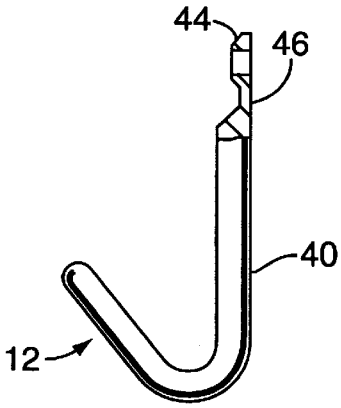
FIG. 5 is a somewhat enlarged side elevational view of the bookbag hook.
Figure 8:
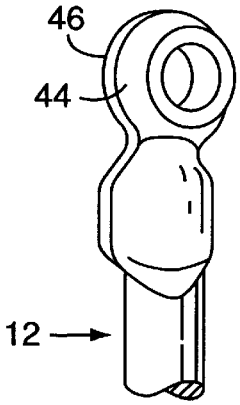
FIG. 8 is somewhat further enlarged fragmentary prospective view of a terminal end portion of the bookbag hook shown in FIGS. 5–7.

Referring now to FIGS. 5–8 the illustrated hook 12 is made from cylindrical steel rod of substantially uniform diameter bent to form a pair of transversely spaced apart generally J-shaped hook side portions 40, 40 integrally connected by a horizontally disposed transverse connecting portion 42 which extends between the lower ends of the J-shaped side portions 40, 40, as best shown in FIGS. 6 and 7. The upper or terminal end portions of the hook, indicated at 44, 44, are formed to generally eyelet configurations for mounting the hook, as shown in the drawings. The eyelet portions 44,44 have substantially flat forwardly facing mounting surfaces 46, 46. The latter mounting surfaces are disposed in planes parallel to associated portions of the hook axis and inclined generally rearwardly and toward each other, as shown in FIG. 6, where the planes of the mounting surfaces 46, 46 are indicated by the letters P, P. Thus, the mounting surfaces 46, 46 are arranged for generally complementary engagement with associated portions of the backrest arcuate rear surface 39 when the hook 12 is assembled with the chair.

Figure 4:
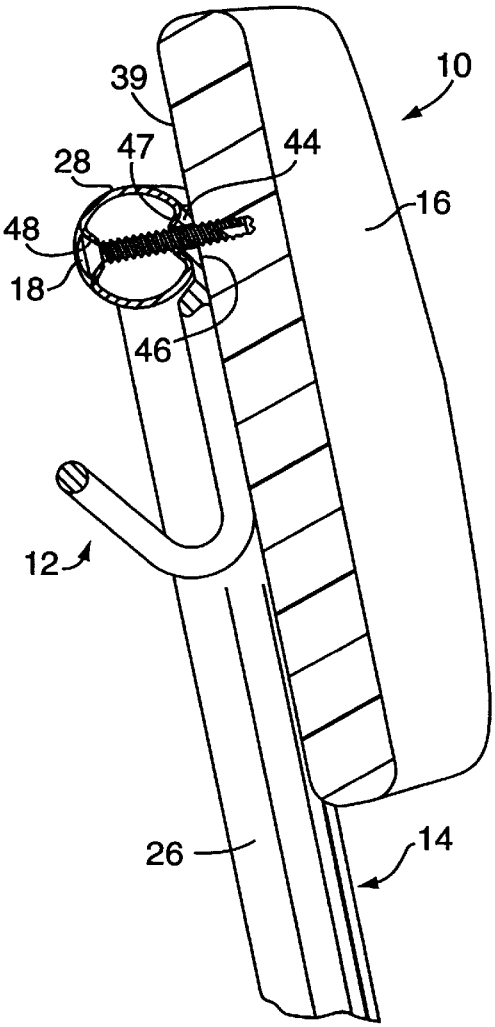
FIG. 4 is a somewhat further enlarged sectional view taken generally along the line 4—4 of FIG. 2.

As previously noted, and in accordance with the invention, the hook 12 is supported on the chair between the backrest 16 and an associated portion of the chair frame 14. Specifically, the horizontally disposed tubular frame member 28 has punched apertures for receiving the fasteners 18, 18 which secure the backrest 16 to the chair frame. The fastener receiving apertures are spaced apart a distance substantially equal to the distance between the apertures defined by the eyelet portion 44, 44 so that the fasteners 18, 18 also secure the hook 12. The punching or piercing operations employed to form the fastener receiving apertures in the tubular member 28 are performed at both the front and rear surfaces of the tubular member and form indentations 47, 47 in the front surface and indentations 48, 48 in the rear surface of the member 28. The indentations 48,48 in the rear surface of the tubular backrest support member 28, one shown in FIG. 4, facilitate the use of oval countersunk trim head fasteners or screws 18,18 substantially as shown. The screws 18, 18, which secure the backrest 16 and the hook 12 are preferably of a self-tapping type headed to receive a special driving tool. TORX fasteners are presently preferred, because such fasteners usually cannot be removed using an improvised tool, which discourages vandalism.

The indentations 47, 47 formed in the forwardly facing portions of the supporting member 28 generally complement the eyelet-shaped terminal end portions 44, 44. When the backrest 16 is mounted on the chair frame 14 each eyelet-shaped end portion 44 is disposed within an associated forwardly facing indentation 47 and secured by an associated fastener 18 which passes through the backrest support member 28 and through the eyelet portion 44. The self-tapping screws 18, 18 tightly engage the backrest 16 and positively secure the backrest to the chair frame 14. The hook 12 depends from the chair frame and more particularly from the frame member 28 in a substantially cantilever position. In assembly, the eyelet portions 44, 44 which retain the hook 12 are substantially concealed, being disposed between the tubular frame member 28 and the backrest 16. Only smooth rounded edges of the hook 12 and the chair frame 14 are exposed at the rear of the chair, thereby substantially eliminating risk of torn clothing or physical injury resulting from contact with the hook or the chair frame. The hook is virtually indestructible. The manner in which it is fastened to the chair discourages removal and other acts of vandalism.

Figure 9:
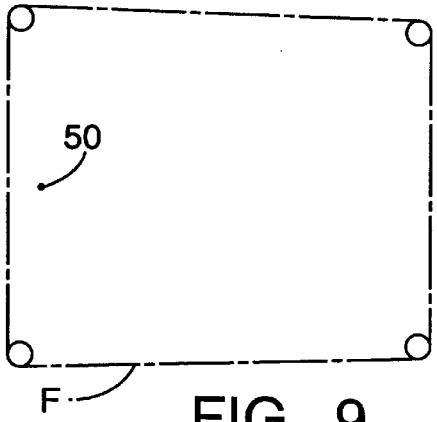
FIG. 9 is a somewhat schematic plan view illustrating the footprint of the chair on a supporting surface.

When the chair is in a normal seating position on a horizontally disposed supporting surface the glides 38, 38 generally define a footprint of the chair indicated by the letter F in FIG. 9. A load suspended from the hook 12, such as, for example, a bookbag (not shown) containing several heavy books has a center of gravity located along a vertical line indicated by the numeral 50 in FIGS. 1, 2 and 9 and passing through the throat of the hook 12, as shown in FIG. 1, and through the footprint F, as best shown in FIG. 9. The centralized position of the hook relative to the chair back, as shown in FIG. 2, positions the center of gravity of a suspended load along the line 50 which is centrally disposed between and slightly forward of the lower ends of the chair rear legs 30, 30. There is virtually no risk that the chair will tip in a lateral direction in response to a hook suspended load. The approximate position of the center of gravity of a hook supported load above the footprint F is shown in FIG. 9 and indicated at 50. Thus, the configuration of the classroom chair 10 is such that a load suspended from the bookbag hook 12 does not exert a tipping force on the chair when it is unoccupied.

Figure 10:
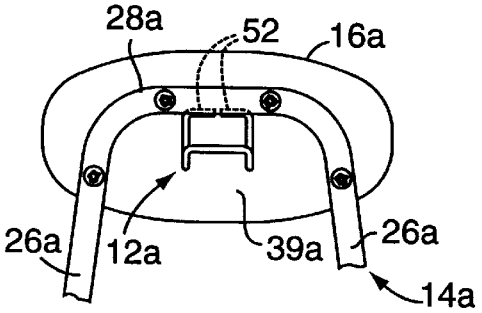
FIG. 10 is a fragmentary rear elevational view of another classroom chair embodying the present invention.
Figure 11:
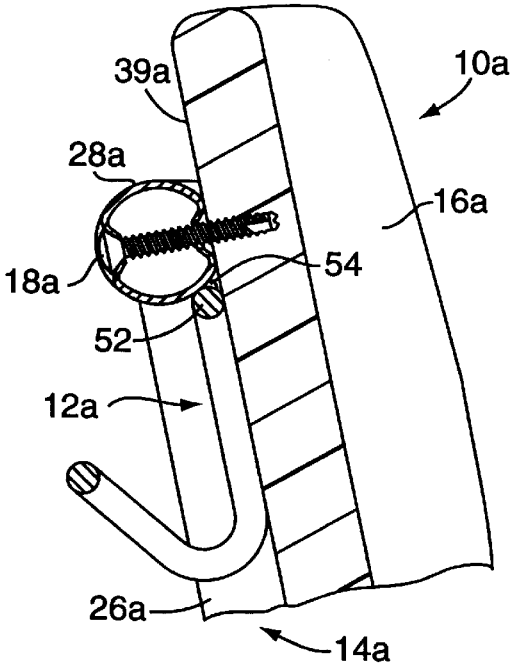
FIG. 11 is a somewhat enlarged fragmentary sectional view taken along the line 11—11 of FIG. 10.

Referring now to FIGS. 10 and 11 there is shown fragmentary views of another classroom chair embodying the present invention indicated generally at 10*a*. Parts of the chair 10*a* which correspond to similar parts of the previously described chair 10 bear the same reference numerals as the previously described parts and will not be hereinafter described in detail. The chair 10*a* differs from the previously described chair 10 particularly with regard to the construction of the hook 12*a* and the manner in which the hook is attached to the chair 10*a*.

Figure 12:
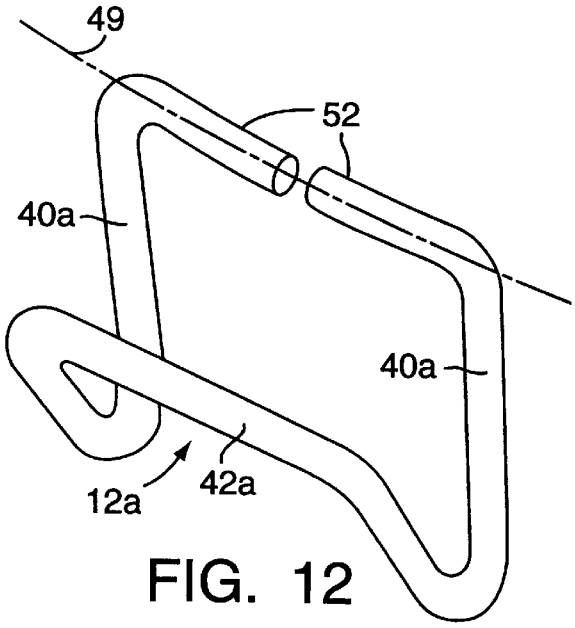
FIG. 12 is a prospective view of the bookbag hook shown in FIGS. 10 and 11.

Like the hook 12, the hook 12*a* is formed from steel rod and may have a plated or painted finish preferably matching the finish on the chair frame. The hook 12*a,* best shown in FIG. 12 has generally J-shaped side portions 40*a,* 40*a* and a central portion 42*a* substantially identical to that of the hook 12, however the terminal end portions of the hook, indicated at 52, 52, are bent inwardly toward each other and are preferably further formed to an arcuate contour to generally conform to the arcuate curvature of the backrest rear surface 39*a*. The arcuate contour of the end portions 52, 52 is generally illustrated by the contour of the axis of the latter end portions, designated by the numeral 49 in FIG. 12. The inwardly directed terminal end portions, 52, 52 comprise the means for mounting the hook 12*a* on the chair frame 14*a*. The latter end portions are disposed generally adjacent and welded to the lower generally forwardly facing portion of the cylindrical tubular chair frame member 28*a,* as shown in FIG. 10. The location of the welds or beads which secure the hook 12*a* to the frame member 28*a* are indicated at 54 in FIG. 11 and preferably disposed along the upwardly facing surfaces of the hook terminal end portions 52, 52 and associated forwardly facing lower surface portions of the frame member 28*a*.

When the rigid backrest 16*a* is secured to the chair frame 14*a* by the fasteners 18*a* the welds at 54 which secure the bookbag hook 12*a* in fixed position to the chair frame member 28*a* are located between the backrest 16*a* and an associated portion of the chair frame member 28*a*. Thus the welds are substantially concealed between the backrest 16*a* and the backrest supporting portion of the chair frame 14*a*. Only smoothly rounded portions of the chair frame and hook are exposed which results in a classroom chair of safe construction having a pleasing appearance and improved utility.

The present invention has been illustrated and described with reference to improvements in a classroom chair of a generally conventional type suitable for use with a separate desk or table. However, it should be understood that the invention may be practiced with chairs of other types, such as, for example, tablet-arm chairs of the type having one wide or broad arm which provides a suitable writing surface, and such modified chair forms are contemplated within the scope of the present invention.

We claim:

1. In a classroom chair having a chair frame, a backrest and fastening means for attaching the backrest to the chair frame and including a fastener, the improvement comprising a bookbag hook, and mounting means including said fastener for securing said bookbag hook in fixed position to said classroom chair, said mounting means being disposed between said backrest and a backrest supporting portion of said chair frame, said fastener passing through said chair frame and said hook, said hook depending in generally cantilever position from said chair frame.

2. In a classroom chair as set forth in claim 1 the improvement wherein said bookbag hook depends in said cantilever position from said backrest supporting portion of said chair frame.

3. In a classroom chair as set forth in claim 1 the improvement wherein said fastener comprises a threaded fastener threadably engaged with said backrest.

4. In a classroom chair as set forth in claim 1 wherein said chair has legs including glides which cooperate to define a footprint on a surface upon which the chair is supported and wherein a center of gravity of a load suspended from said bookbag hook on the supported chair lies along a vertical line which passes through the footprint.

5. In a classroom chair as set forth in claim 1 the improvement wherein said bookbag hook comprises an axially elongated bent rod having opposite end portions comprising said mounting means.

6. In a classroom chair as set forth in claim 5 the improvement wherein said chair frame comprises a tubular frame wherein said opposite end portions comprise eyelet shaped formed end portions and said frame has indentations therein, each of said formed end portions being received within and generally complementing an associated one of said indentations.

7. In a classroom chair including a tubular chair frame having a backrest supporting portion, a backrest, and attaching means for securing the backrest to said backrest supporting portion, the improvement comprising; a bookbag hook defined by an axially elongated bent rod having generally eyelet shaped end portions, each of said eyelet shaped end portions having an aperture therethrough, said backrest supporting portion having spaced apart indentations therein, each one of said eyelet shaped end portions received within and generally complimenting an associated one of said indentations, said attaching means including a pair of threaded fasteners, each one of said fasteners passing through said backrest supporting portion and through an associated one of said apertures and threadably engaging said backrest, said fasteners cooperating with said backrest supporting portion and said backrest to secure said backrest to said backrest supporting portion and to secure said bookbag hook to said chair in depending relation to said chair frame with said eyelet shaped end portions of said bookbag hook disposed between said backrest supporting portion and said backrest.

8. In a classroom chair as set forth in claim 7 the improvement wherein said chair frame includes legs having glides which define a footprint on a surface upon which the chair is supported and wherein a center of gravity of a load suspended from said bookbag hook on the supported chair lies along a vertical line passing through said footprint.

9. In a classroom chair having a tubular chair frame, a backrest and fastening means for attaching the backrest to the chair frame, the improvement comprising said tubular frame having indentations therein, a bookbag hook, and mounting means for securing said bookbag hook in fixed position to said classroom chair, said mounting means being disposed between said backrest and a backrest supporting portion of said chair frame, said hook comprising an axially elongated bent rod having eyelet shaped formed opposite end portions, each of said formed opposite end portions being received within and generally complementing an associated one of said indentations, said formed opposite end portions comprising said mounting means.

10. In a classroom chair as set forth in claim 9 the improvement wherein each of said formed opposite end portions has an aperture therethrough and said fastening means includes a pair of mounting fasteners, each of said mounting fasteners extending through said chair frame and through said aperture in one of said formed opposite end portions.

11. In a classroom chair as set forth in claim 9 the improvement wherein said fastening means comprise threaded fasteners and each of said threaded fasteners is threadably engaged with said backrest.

12. In a classroom chair having a chair frame, a backrest and fastening means for attaching the backrest to the chair frame and including a pair of mounting fasteners, the improvement comprising a bookbag hook, and mounting means including said mounting fasteners for securing said bookbag hook in fixed position to said classroom chair, said mounting means being disposed between said backrest and a backrest supporting portion of said chair frame, said mounting fasteners passing through said chair frame and said hook, said hook depending in generally cantilever position from said chair frame.

13. In a classroom chair as set forth in claim 12 the improvement wherein said bookbag hook comprises an axially elongated bent rod having opposite end portions and said portions comprise said mounting means.

14. In a classroom chair as set forth in claim 13 the improvement wherein each of said mounting fasteners passes through said chair frame and one of said opposite end portions.

* * * * *